US005149944A

United States Patent [19]

Shimomura

[11] Patent Number: 5,149,944

[45] Date of Patent: Sep. 22, 1992

[54] ELECTRIC COOKING APPLIANCE

[75] Inventor: Nobuo Shimomura, Nagoya, Japan

[73] Assignee: Kabushiki Kaisha Toshiba, Kanagawa, Japan

[21] Appl. No.: 716,086

[22] Filed: Jun. 17, 1991

[30] Foreign Application Priority Data

Jun. 26, 1990 [JP] Japan ..... 2-167473

[51] Int. Cl.[5] ..... H05B 3/74

[52] U.S. Cl. ..... 219/464; 219/449

[58] Field of Search ..... 219/448, 449, 464, 465

[56] References Cited

U.S. PATENT DOCUMENTS

| | | | |
|---|---|---|---|
| 3,330,939 | 7/1967 | Jacobs | 219/449 |
| 4,639,578 | 1/1987 | Payne | 219/449 |
| 4,700,051 | 10/1987 | Goessler | 219/464 |
| 4,740,664 | 4/1988 | Payne | 219/449 |

*Primary Examiner*—Teresa J. Walberg
*Attorney, Agent, or Firm*—Philip M. Shaw, Jr.

[57] ABSTRACT

An electric cooking appliance includes a heater lamp such as a halogen lamp, a top plate on which a cooking pan is placed, the top plate being disposed over the heater lamp, a thermostat sensing an ambient temperature of the heater lamps, and a microcomputer serving to output an controlled output value command for controlling an output of the heater lamp and to control the output of the heater lamp so that the output of the heater lamp is gradually decreased based on the controlled output value command every time the temperature sensed by the thermostat takes a predetermined value or more. The microcomputer further serves to determine a degree of heat absorptivity of the cooking pan in accordance with the controlled output value command in the condition that the cooking pan is placed on the top plate, thereby determining whether or not the cooking pan is suitable for the cooking. The result of determination of the microcomputer is displayed on a display. The controlled output value command takes either a value obtained a predetermined period of time after initiation of energization of the heater lamp or a value obtained when the control of gradually decreasing the output of the heater lamp is interrupted for a predetermined period of time or more.

7 Claims, 8 Drawing Sheets (a)
Atmospheric temperature in heating unit
800℃
Temperature of water
100℃
A
B
(b)
Thermostat
ON
OFF
(c)
Output of each halogen lamp group
2kw
1.6kw
1 kw
0
(d)
Light-emitting diodes
17a ON OFF
17b ON OFF
17c ON OFF
17d ON OFF
17e ON OFF
T1 T2 T3 T4
10 minutes
Time

ELECTRIC COOKING APPLIANCE

BACKGROUND OF THE INVENTION

This invention relates generally to electric cooking appliances heating a cooking utensils such as cooking pans containing foodstuff to be cooked, and more particularly to such an electric cooking appliance employing a heater lamp as a heat source.

A halogen lamp is generally employed as a heater lamp in electric cooking appliances of the type described above which have recently been tried to be practiced. More specifically, the electric cooking appliance generally comprises a heating unit including a plurality of groups of halogen lamps, each group being made up of a plurality of halogen lamps, and a heat insulator covering the peripheral and bottom sides of the halogen lamps, and a top plate formed from a heat-proof glass having a good heat transmission property and covering the top opening of the heat insulator, thereby providing for construction with small heat loss. In use, a cooking pan or the like containing foodstuff is placed on the top plate and the heat generated by the halogen lamps is applied to the cooking pan so that the foodstuff contained in it is cooked.

In the above-described electric cooking appliance, heat generated by the halogen lamps is radiated or transmitted through the top plate to the cooking pan and accordingly a heated object contained in it. Since the heat capacity of the cooking pan is rendered relatively large, the temperature of the cooking pan is not raised so rapidly at an initial stage of the heating and the rise characteristic of the cooking pan temperature is lowered. Consequently, the halogen lamps of the high output type (usually 2 kW) have been conventionally employed as the heater lamps so that the cooking pan temperature is raised rapidly.

On the other hand, the heat insulator and the top plate are closely disposed for the purpose of enhancing the heating efficiency in the above-described electric cooking appliance and consequently, the interior of the heating unit is rendered a sealed space. For this reason, when the halogen lamps are continuously energized with the output of each of them maintained at a high level, the ambient temperature of the halogen lamps or an atmospheric temperature in the heating unit is gradually increased to exceed the critical heat proof temperature (about 850° C.) of a quartz glass tube constituting the bulbs of the halogen lamps. In order to solve this problem, the conventional electric cooking appliance is provided with a thermostat as temperature sensing means for sensing the atmospheric temperature of the heating unit interior. The thermostat operates to deenergize the halogen lamps when the atmospheric temperature of the heating unit interior is increased to a predetermined value.

Making a good choice of the cooking pan is necessary in cooking with the above-described electric cooking appliance employing the halogen lamps. More specifically, the heat generated by the halogen lamps is radiated or transmitted through the top plate to the cooking pan and the heated object, as described above. An amount of heat transmitted to the cooking pan depends largely upon the material or configuration of the cooking pan used. The amount of heat transmitted to the cooking pan is increased as the material forming the cooking pan has a larger heat transfer coefficient and higher heat conductivity. Further, when the cooking pan has a flat bottom face, a contact area of the pan with the top plate is increased and accordingly, the heat transfer efficiency is increased, which increases the amount of heat transferred to the cooking pan. The heat generated by the halogen lamps is absorbed by the cooking pan more efficiently as the amount of heat transferred to the cooking pan is increased more. Consequently, the temperature of each halogen lamp bulb is not so much increased and a cooking period of time is shortened. Contrarily, in the case where the cooking pan has a small heat transfer efficiency such that the amount of heat transferred to the pan is small, the temperature of the cooking pan is not so much increased even when the output of each halogen lamp is uselessly increased. In such a case the cooking period of time is lengthened and only the temperature of each halogen lamp bulb is raised, which shortens the life of each halogen lamp.

Thus, the life of the halogen lamp and the cooking period of time are influenced by the selection of the cooking pan to be used in the cooking with the above-described electric cooking appliance. Consequently, it has been desired for the user to ascertain whether or not the selected cooking pan is suitable for the electric cooking appliance.

SUMMARY OF THE INVENTION

Therefore, an object of the present invention is to provide an electric cooking appliance wherein the degree of heat absorptivity of the selected cooking pan can be determined and an indication of the determined suitability of the cooking pan can be displayed.

The present invention provides an electric cooking appliance comprising a heater lamp, a top plate on which a cooking pan containing foodstuff to be cooked is placed, the top plate being disposed over the heater lamp, determination means for determining a degree of heat absorptivity of the cooking pan in the condition that the cooking pan is placed on the top plate, and display means for displaying a result of determination of the determination means.

Preferably, the electric cooking appliance may comprise a heater lamp, a top plate on which a cooking pan containing foodstuff to be cooked is placed, the top plate being disposed over the heater lamp, temperature sensing means for sensing an ambient temperature of the heater lamp, output control means delivering a controlled output value command for controlling an output of the heater lamp, the output control means controlling the output of the heater lamp so that the output of the heater lamp is gradually decreased based on the controlled output value command every time the temperature sensed by the temperature sensing means takes a predetermined value or more, determination means for determining a degree of heat absorptivity of the cooking pan in accordance with the controlled output value command in the condition that the cooking pan is placed on the top plate, and display means for displaying a result of determination of the determination means Since the suitability of the selected cooking pan placed on the top plate is determined from the degree of heat absorptivity of the cooking pan, a cooking pan can be selected which has the degree of heat absorptivity balanced with the magnitude of the heater lamp output. Consequently, the life of the heater lamp bulb can be prevented from being expired at an early stage and the heat efficiency can be improved.

Further, the determination of suitability of the cooking pan is based on the controlled output value command delivered from the output control means for controlling the heater lamp so that the output of the heater lamp is gradually decreased. Consequently, whether the heater lamp output is balanced with the heat absorbing capacity of the cooking pan or not, that is, whether the cooking pan is suitable for the cooking with the electric cooking appliance or not can be determined with accuracy.

Other objects of the present invention will become obvious upon understanding of the illustrative embodiment about to be described. Various advantages not referred to herein will occur to one skilled in the art upon employment of the invention in practice.

DESCRIPTION OF THE PREFERRED EMBODIMENTS

One embodiment of the electric cooking appliance in accordance with the present invention will be described with reference to FIGS. 1 to 8 of the drawings.

Figure 1:
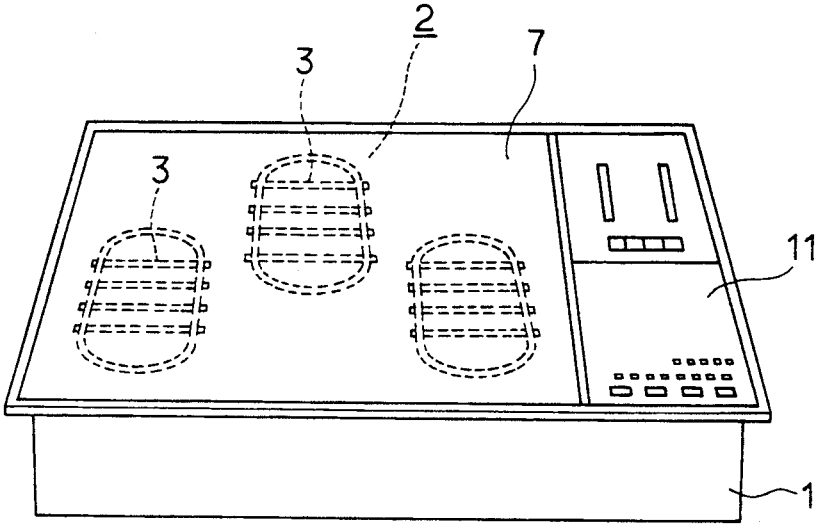
FIG. 1 is a perspective view of the electric cooking appliance of one embodiment in accordance with the present invention.
Figure 2:
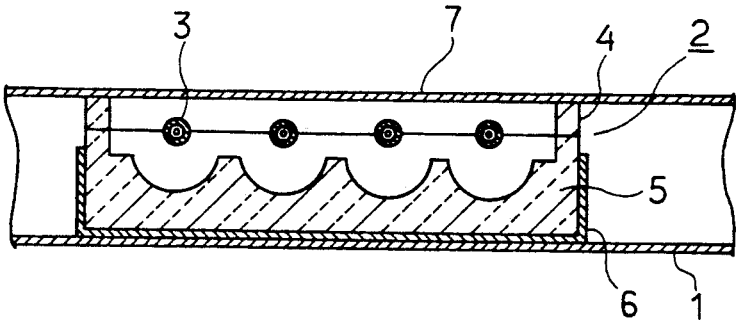
FIG. 2 is an enlarged longitudinal section of a heating unit employed in the electric cooking appliance.
Figure 3:
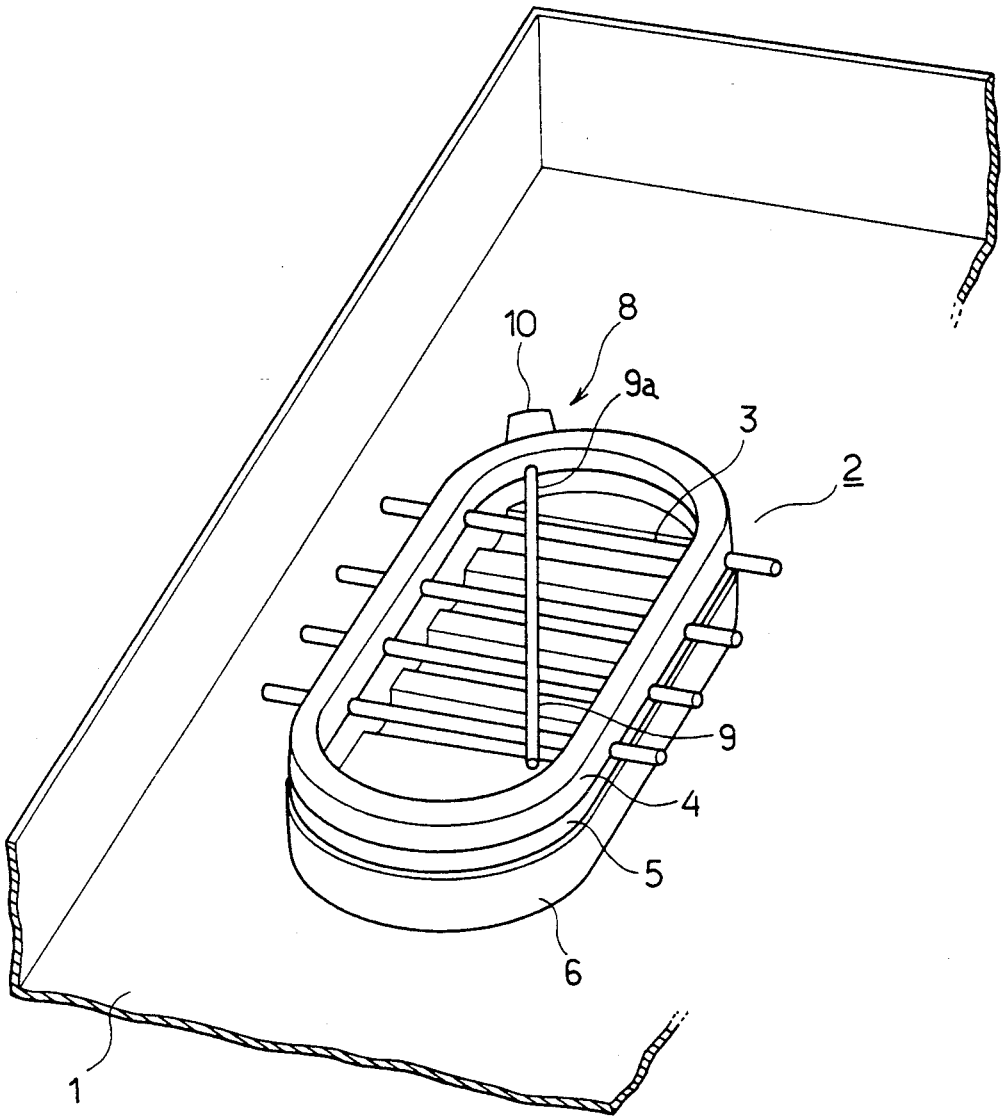
FIG. 3 is an enlarged perspective view of the heating unit with the top plate removed.
Figure 4:
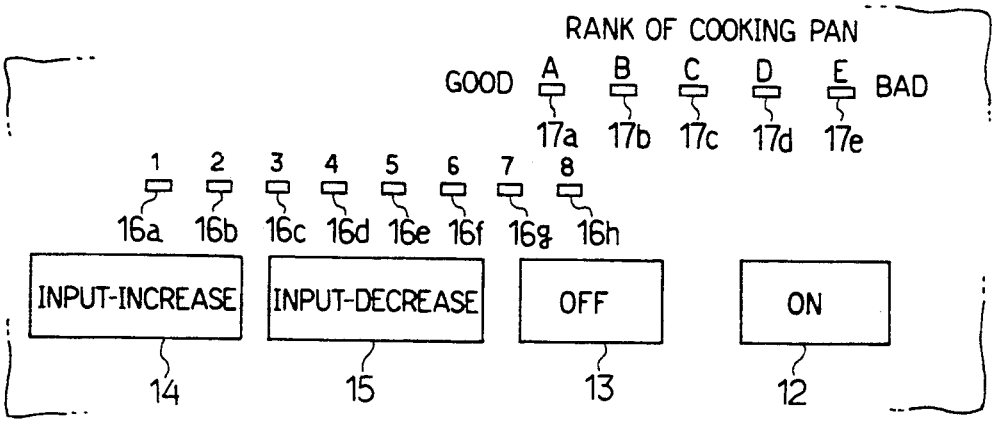
FIG. 4 is a partially enlarged front view of an operation panel of the electric cooking appliance.

Referring to FIG. 1, an outer frame 1 of the electric cooking appliance is formed into the shape of a flat rectangular box. Three heating units 2 are provided in the outer frame 1, for example Each heating unit 2 comprises a plurality of halogen lamps 3 serving as heater lamps and slenderly circular upper and lower heat-insulators 4 and 5 for supporting the halogen lamps 3, as shown in FIGS. 2 and 3. The bottomed lower heat-insulator 5 is received by a receptacle 6 secured to the inner bottom of the outer frame 1. An upper opening of the upper heat-insulator 4 of each heating unit 2 is covered by a heat-transmissible top plate 7 formed from a piece of heat-proof glass. The top plate 7 is disposed close to the upper heat-insulator 4 so as to seal the heating unit 2. A thermostat 8 serving as temperature sensing means is provided for sensing an atmospheric temperature in the heating unit 2 or an ambient temperature of the halogen lamps 3. As well known in the art, the thermostat 8 comprises a heat-sensitive section 9 including a metallic bar (not shown) disposed in a metallic outer tube 9*a* so as to expand and contract in response to the temperature changes and a switch section 10 turned on and off in response to the expansion and contraction of the metallic bar of the heat-sensitive section 9. The heat-sensitive section 9 is disposed in the heating unit 2 so as to sense the ambient temperature of the halogen lamps 3. The switch section 10 is disposed outside the heating unit 2. The thermostat 8 is designed so as to be turned off when the sensed temperature exceeds a predetermined value, for example, 750° C. An operation panel 11 is provided on the outer frame 1 so as to be substantially planar to the top plate 7, as shown in FIG. 1. As shown in FIG. 4, the operation panel 11 includes an ON switch 12 for starting the heating operation, an OFF switch 13 for stopping the heating operation, INPUT-INCREASE and INPUT-DECREASE switches 14 and 15 for adjusting the calorific value of each halogen lamp 3 group or the input power to each halogen lamp 3 group. The operation panel 11 further includes a plurality of light-emitting diodes 16*a* to 16*h* indicating the magnitude of the input to each halogen lamp 3 group and a plurality of light-emitting diodes 17*a* to 17*e* serving as display means for displaying the degree of suitability of a cooking utensil such as a cooking pan placed on the top plate with respect to the heat absorptivity. The above-described switches 12 to 15 and light-emitting diodes 16*a*–16*h* and 17*a*–17*e* are provided for each heating unit 2 and such switches and light-emitting diodes for one heating unit 2 are shown in the drawings for convenience' sake.

Figure 5:
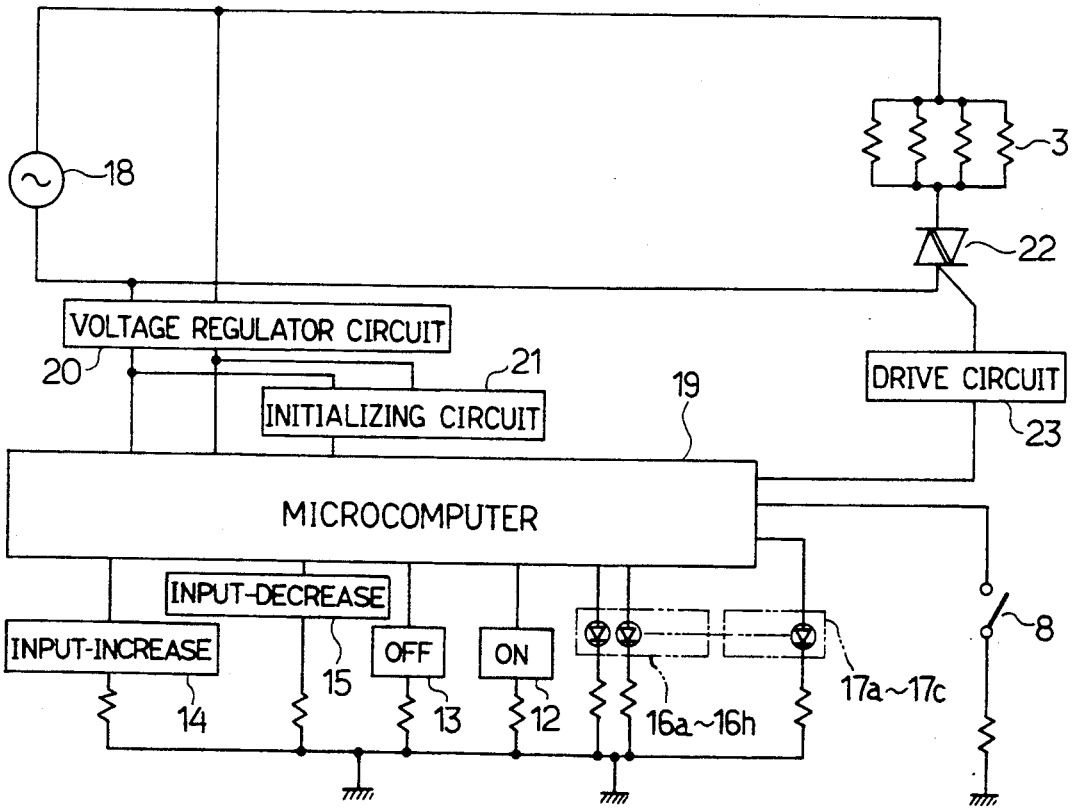
FIG. 5 is an electric circuit diagram showing an electrical arrangement of the electric cooking appliance.

FIG. 5 illustrates an electric circuit arrangement of the electric cooking appliance concerning one of the heating units 2. In each heating unit 2, four halogen lamps 3 are connected in parallel with an ac power source 18. Each group of the h alogen lamps 3 is controlled by a microcomputer 19 so as to be energized and deenergized. The microcomputer 19 is powered by a voltage regulator circuit 20 connected to the ac power source 18. An initializing circuit 21 is provided between the voltage regulator circuit 20 and the microcomputer 19. The initializing circuit 21 detects the voltage at the voltage regulator circuit 20 raised to a predetermined value or more at the time of power supply to the cooking appliance to initialize the microcomputer 19.

The microcomputer 19 is provided for controlling various electrical parts incorporated in the electric cooking appliance. Upon receipt of signals from the thermostat 8 and the various switches 12–15, the microcomputer 19 produces an controlled output value command in accordance with the received input signal Based on the controlled output value command, the microcomputer 19 controls, via a drive circuit 23, a triac 22 connected in series to the halogen lamp 3 group, thereby controlling each halogen lamp 3 group so the halogen lamps 3 are energized and deenergized. When the ON switch 12 is operated, each halogen lamp 3 group is continuously energized until the OFF switch 13 is operated The output or calorific value of each halogen lamp 3 group during its energization is controlled by the microcomputer 19 so as to be maintained at the high output in an "on" period of the thermostat 8 and at the low output in an "off" period of the thermostat 8, the low output ranging between one third and two thirds of the maximum output (2 kW). The low output is set to the value of 1 kW in the embodiment. The above-described halogen lamp output control is performed by way of the phase control of the triac 22.

The output of each halogen lamp 3 group can be manually set with the INPUT-INCREASE and INPUT-DECREASE switches 14 and 15 in the "on" period of the thermostat 8. One of the light-emitting diodes 16*a*–16*h* indicative of the magnitude of the set output is activated. The set output is gradually decreased in response to the signals from the thermostat 8. More specifically, the microcomputer 19 is programmed so that the output of each halogen lamp 3 group is gradually decreased by 5% (0.1 kW) of the maximum output (2 kW) in the following "on" period every time the thermostat 8 senses the predetermined value or more to be turned off, after a preselected time, for example after initiation of the cooking by application of heat. In this case the gradually decreased critical output of each halogen lamp 3 group is set at a predetermined output value, for example 1.6 kW. The microcomputer 19 is further programmed so that when the output of each halogen lamp 3 group is decreased to the value of 1.6 kW, it is maintained at 1.6 kW in the subsequent "on" periods even when the thermostat 8 is turned off. The microcomputer 19 thus serves as output control means producing a controlled output value command so that the output of each halogen lamp 3 group is controlled in the above-described manner.

The microcomputer 19 is also provided with a function as determination means for determining the suitability of a cooking pan placed on the top plate 7 or the degree of heat absorptivity of the cooking pan. The microcomputer 19 is programmed so that it serves as the determination means when an initial output of each halogen lamp 3 group is set at the maximum output of 2 kW. The determination of suitability of the cooking pan with respect to the heat absorptivity is performed based on the following principle The output of each halogen lamp 3 group is decreased by 0.1 kW every time the thermostat 8 senses the predetermined value or more to be turned off, as described above. When the calorific value of each halogen lamp 3 group is balanced with the amount of heat absorbed by the cooking pan during the control in which the output of each halogen lamp 3 group is gradually decreased, the atmospheric temperature in the heating unit 2 is not increased to the minimum value at which the thermostat 8 was turned off at the last time and subsequently, each halogen lamp 3 group maintains a minimum constant output condition. Accordingly, it can be determined that the output or calorific value of each halogen lamp 3 group at the time of initiation of the constant output condition corresponds to the amount of heat absorbed by the cooking pan. Consequently, it can be determined that the suitability of the cooking pan with respect to the heat absorptivity is higher as the output of each halogen lamp 3 group at the time of initiation of the constant output condition is large.

The microcomputer 19 determines the suitability of the cooking pan from the controlled output value command corresponding to the output condition of each halogen lamp 3 at the time ten minutes after the energization, in view of the circumstances that the time when each halogen lamp 3 is led into the constant output condition is within ten minutes from initiation of energization of each halogen lamp 3 group. The result of determination is displayed by either one of the light-emitting diodes 17*a*–17*e*. For example, when the output of each halogen lamp 3 group is 2 kW at the time ten minutes after the initiation of energization, the suitability of the cooking pan is determined to be in a highest rank A and the corresponding light-emitting diode 17*a* in FIG. 4 is activated. In the same manner, every time the output of each halogen lamp 3 group at the time ten minutes after the initiation of energization is decreased by 0.1 kW such as 1.9 kW, 1.8 kW and so forth, the suitability of the cooking pan is determined to be in a rank B, a rank C and so forth and respective corresponding light-emitting diodes 17*b*, 17*c* and so forth are activated. When the INPUT-INCREASE switch 14 is operated to set the output of each halogen lamp 3 group at the maximum output of 2 kW in the condition that the output of each halogen lamp 3 group has been gradually decreased, the microcomputer 19 is initialized concerning the determination of the suitability of the cooking pan, performing the determination again.

Although the determination of the suitability of the cooking pan is performed based on the controlled output value command corresponding to the output condition of each halogen lamp 3 group, the determination may be based on the number of times of "off" operations of the thermostat 8 in the period from the initiation of energization of each halogen lamp 3 to the time ten minutes after the same. This manner is substantially the same as the foregoing manner in which the cooking pan suitability is determined based on the controlled output value command corresponding the output condition of each halogen lamp 3 group.

Figure 6:
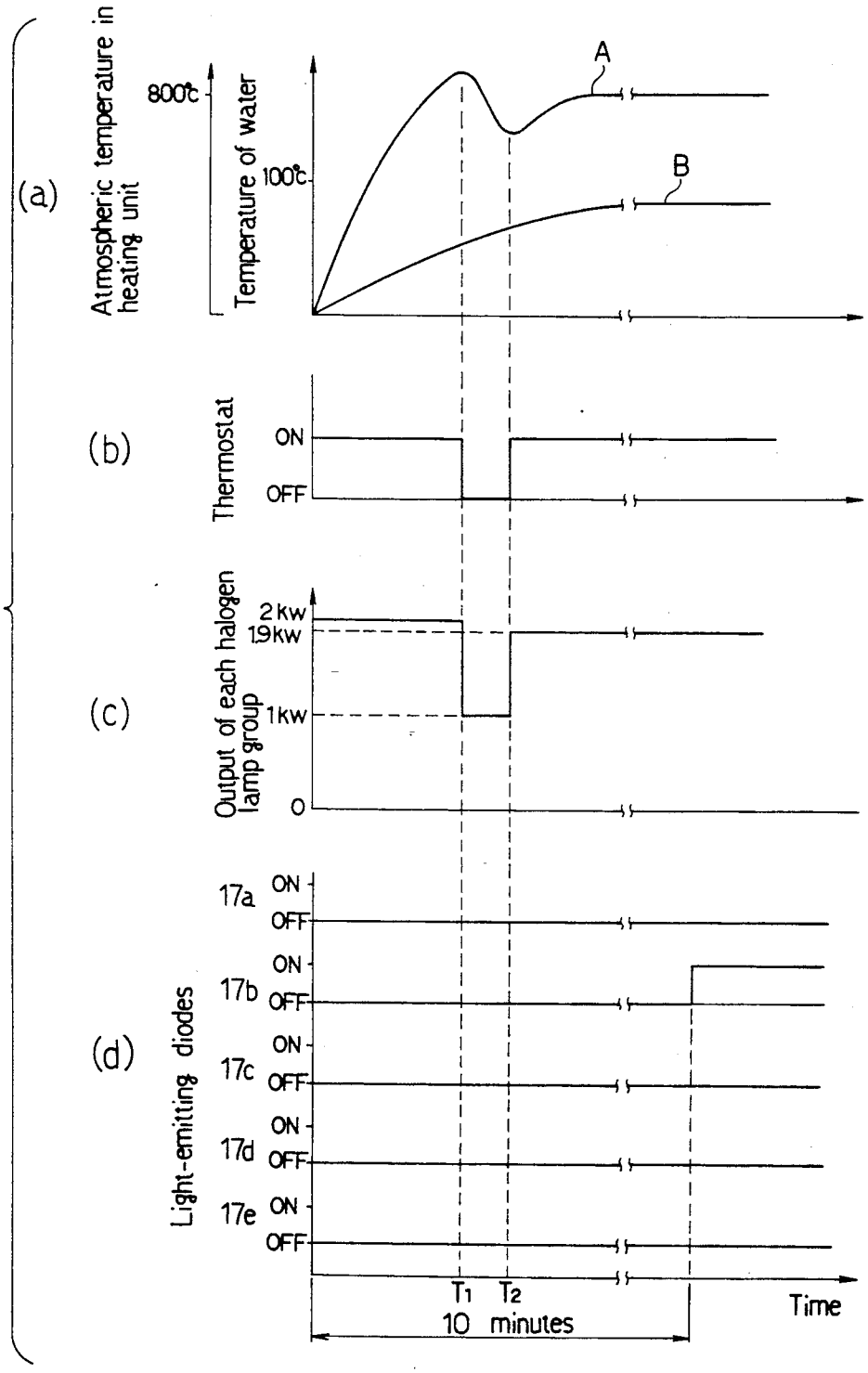
FIGS. 6(*a*) to 6(*d*) are time charts showing the operation of the electric cooking appliance when a cooking pan with a high level of heat absorptivity is used.

The operation of the electric cooking appliance will now be described with reference to FIGS. 6(*a* )–6(*d*) and 7(*a*)–7(*d*). In these Figures, reference character A designates the atmospheric temperature in the heating unit and reference character B the temperature of water contained in the cooking pan. FIGS. 6(*a*) to 6(*d*) show a case where a cooking pan with high heat absorptivity containing an amount of water is heated and FIGS. 7(*a*) to 7(*d*) a case where a cooking pan with low heat absorptivity containing the same amount of water is heated. Referring first to FIGS. 6(*a*) to 6(*d*), the ON switch 12 is manually operated to initiate the heating and then, either the INPUT-INCREASE switch 14 or INPUT-DECREASE switch 15 is operated to set the output of each halogen lamp 3 group. Suppose now that the output of each halogen lamp 3 group is set at the maximum output of 2 kW. Heat generated by each halogen lamp 3 is directly radiated or transmitted through the top plate 7 to the cooking pan placed on it so that the cooking pan is heated. The atmospheric temperature in the heating unit 2 is rapidly raised with heating The thermostat 8 is turned off at time $T_1$ in FIGS. 6(*a*)–6(*d*) when the atmospheric temperature in the heating unit 2 is raised to a predetermined value or more. Upon receipt of an OFF signal, the microcomputer 19 operates to decrease the output of each halogen lamp 3 group to the low output of 1 kW. The thermostat 8 is turned on at time $T_2$ when the atmospheric temperature in the heating unit 2 is decreased to a value as the result of reduction in the output of each halogen lamp 3 group to a large extent Upon receipt of an ON signal, the microcomputer 19 operates to set the output of each halogen lamp 3 group at the high output. In this case the phase control via the triac 22 is performed by the microcomputer 19 so that the output of each halogen lamp 3 group is decreased by 0.1 kW from the value at the time of the previous high output (2 kW) condition. Consequently, heat is generated by the halogen lamps 3 under the condition that the output of each halogen lamp 3 group is decreased from 2 kW to 1.9 kW. The atmospheric temperature in the heating unit 2 is again raised as the result of heat generation from each halogen lamp 3 group. However, since the output of each halogen lamp 3 group is reduced by one step, the calorific value of each halogen lamp 3 group is approximately balanced with the amount of heat absorbed by the cooking pan in the case of FIGS. 6(*a*)–6(*d*). Consequently, the atmospheric temperature in the heating unit 2 is not raised to the value at which the thermostat 8 is turned off subsequently. Each halogen lamp 3 group is continuously energized so as to deliver the constant output of 1.9 kW. The condition of the above-described balance of the calorific value of each halogen lamp 3 group with the amount of heat absorbed by the cooking pan is established about ten minutes after the initiation of energization to each halogen lamp 3 group. When ten minutes elapses from the energization to the halogen lamp 3 groups, the microcomputer 19 operates to determine the suitability of the cooking pan based on the gradually decreased output of each halogen lamp 3 group at that time. Since the controlled output value command for gradually decreasing the output of each halogen lamp 3 group represents the value of 1.9 kW which value is the output value of each halogen lamp 3 group, the suitability of the cooking pan is determined to be in the rank B and the corresponding light-emitting diode 17*b* is activated as shown in FIG. 6(*d*) to inform the user that the suitability of the cooking pan is in the rank B. The OFF switch 13 is operated after heating is performed for a desired period of time, thereby completing the cooking.

Figure 7:
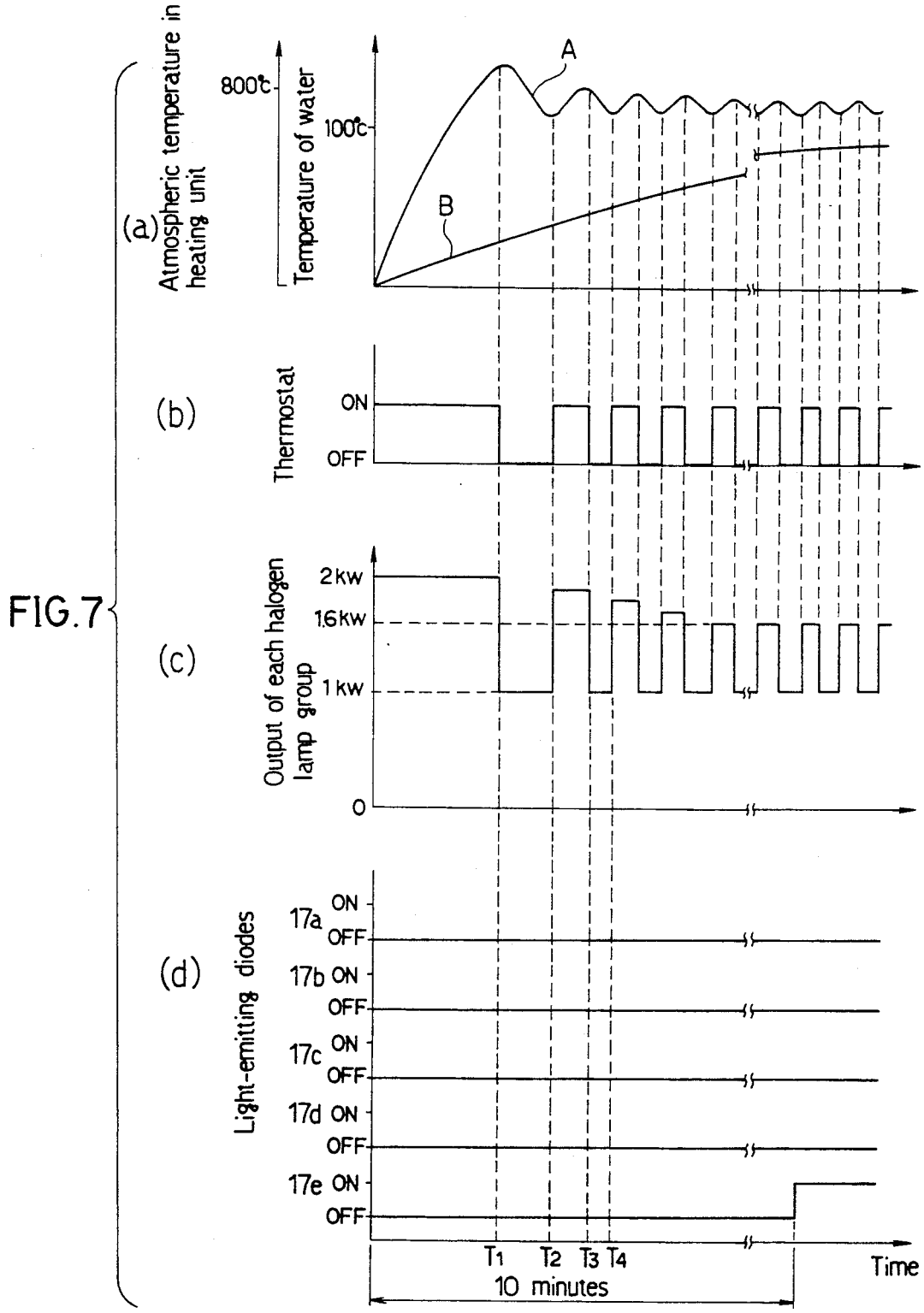
FIGS. 7(*a*) to 7(*d*) are also time charts showing the operation of the electric cooking appliance when a cooking pan with a low level of heat absorptivity is used.

The case of the cooking pan with low heat absorptivity will now be described with reference to FIGS. 7(*a*)–7(*d*). Suppose now that the output of each halogen lamp 3 is set at 2 kW in the same manner as described above and the heating is initiated. The cooking pan placed on the top plate 7 is then heated and a large amount of heat is reflected on the cooking pan surface, which rapidly increases the atmospheric temperature in the heating unit 2. When the atmospheric temperature in the heating unit 2 is raised to a predetermined value, the thermostat 8 is turned off such that the output of each halogen lamp 3 group is decreased to the value of 1 kW to a large extent at time $T_1$ in FIGS. 7(*a*)–7(*d*). The thermostat 8 is then turned on when the atmospheric temperature in the heating unit 2 is decreased to some extent as the result of the above-described decrease in the output of each halogen lamp 3 group. Consequently, the thermostat 8 is again turned on such that heat is generated, at time $T_2$ in FIGS. 7(*a*)–7(*d*), from each halogen lamp 3 group at the output of 1.9 kW lower by 1 kW than the output value at the time of the previous high output (2 kW) condition. In this case, however, since the heat absorptivity of the cooking pan is low, the calorific value of each halogen lamp 3 group is still larger than the amount of heat absorbed by the cooking pan even when the output of each halogen lamp 3 group is decreased to 1.9 kW. Consequently, the output of each halogen lamp 3 group is decreased to 1 kW when the atmospheric temperature in the heating unit 2 is raised to the predetermined value again and the thermostat 8 is turned off again at time $T_3$ in FIGS. 7(*a*)–7(*d*). Then, the atmospheric temperature in the heating unit 2 is decreased and the thermostat 8 is turned on. Consequently, each halogen lamp 3 group is energized at time $T_4$ in FIGS. 7(*a*)–7(*d*) so that heat is generated at the output of 1.8 kW obtained by reducing by 0.1 kW the output value at the time of the previous high output (1.9 kW) condition.

As described above, the output of each halogen lamp 3 group in the high output mode is gradually decreased by 0.1 kW every time the thermostat 8 is turned off. When the output of each halogen lamp 3 group is decreased to 1.6 kW, it is maintained at the value subsequently irrespective of the condition of the thermostat 8. The thermostat 8 is turned on and off subsequently in the case where the output of each halogen lamp 3 group exceeds the amount of heat absorbed by the cooking pan when the output of each halogen lamp 3 group is decreased to 1.6 kW. However, since the output of each halogen lamp 3 group approaches the amount of heat absorbed by the cooking pan closer, the thermostat 8 is turned on and off at longer intervals. The changes in the intervals are ignored in FIGS. 7(*a*)–7(*d*).

Figure 8:
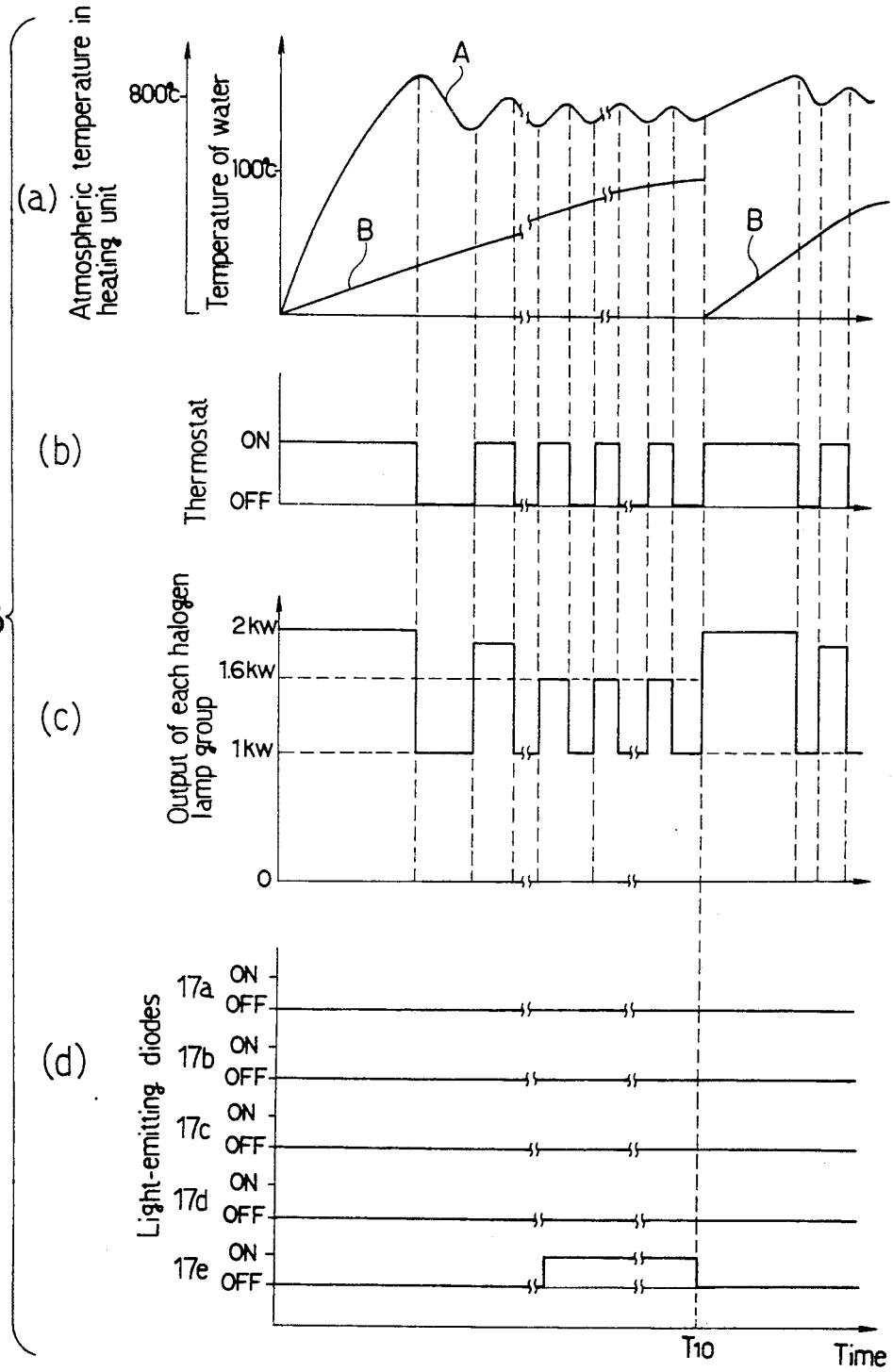
FIGS. 8(*a*) to 8(*d*) are views similar to FIGS. 6(*a*) to 6(*d*) showing the case where the cooking pan is exchanged to another in the midst of the heating operation.

The atmospheric temperature in the heating unit 2 is thus controlled by the thermostat 8 so as not to exceed the critical heat-proof temperature of each halogen lamp 3, thereby controlling the output of each halogen lamp 3 group to perform the heating for the cooking. Upon a lapse of ten minutes from the initiation of energization of the halogen lamp 3 groups, the microcomputer 19 operates to determine the suitability of the cooking pan from the controlled output value command defining the value of the output of each halogen lamp 3 to be decreased at that time. In this case since the controlled output value command represents the value of 1.6 kW, the microcomputer operates to determine the suitability of the cooking pan as the lowest rank E and to activate the corresponding diode 17*e* as shown in FIG. 7(*d*), thereby indicating to the user that the suitability of the cooking pan is in the rank E. The OFF switch 13 is operated to complete the cooking after the cooking pan is heated for a desirable period of time. It is sometimes the case that after the heating is performed with a cooking pan, the heating is executed with another cooking pan, as is shown in FIGS. 8(*a*)–8(*d*). In such a case, the halogen lamp 3 groups are maintained at the energized condition without operation of the OFF switch 13. One cooking pan is exchanged to another one at the time $T_{10}$ in FIGS. 8(*a*)–8(*d*) and then, the INPUT-INCREASE switch 14 is operated so that the output of each halogen lamp 3 group is set at the maximum value of 2 kW. The microcomputer 19 is then initialized with respect to the operation of determining the suitability of the cooking pan, executing the determination of the suitability of another cooking pan placed on the hot plate 7.

In accordance with the above-described embodiment, the suitability of the cooking pan placed on the top plate 7 regarding its heat absorptivity is displayed by either one of the light-emitting diodes 17*a*–17*e*. Consequently, the user can get information about how the selected cooking pan is suitable for the cooking with the electric cooking appliance and can determine that the cooking pans having the low ranks of suitability will be better not to be used in the cooking with the electric cooking appliance.

The output or the calorific value of each halogen lamp 3 group is automatically controlled so as to be decreased step by step to be balanced with an amount of heat absorbed by the cooking pan and the like, every time the thermostat 8 senses the temperature above the predetermined value to be turned off. Accordingly, the number of on-off actions of the thermostat 8 and that is, the number of operations of switching the output level of each halogen lamp 3 group can be reduced. Consequently, the number of large variations in the current flowing through each halogen lamp 3 group can be reduced, which can improve the life of each halogen lamp 3.

Figure 9:
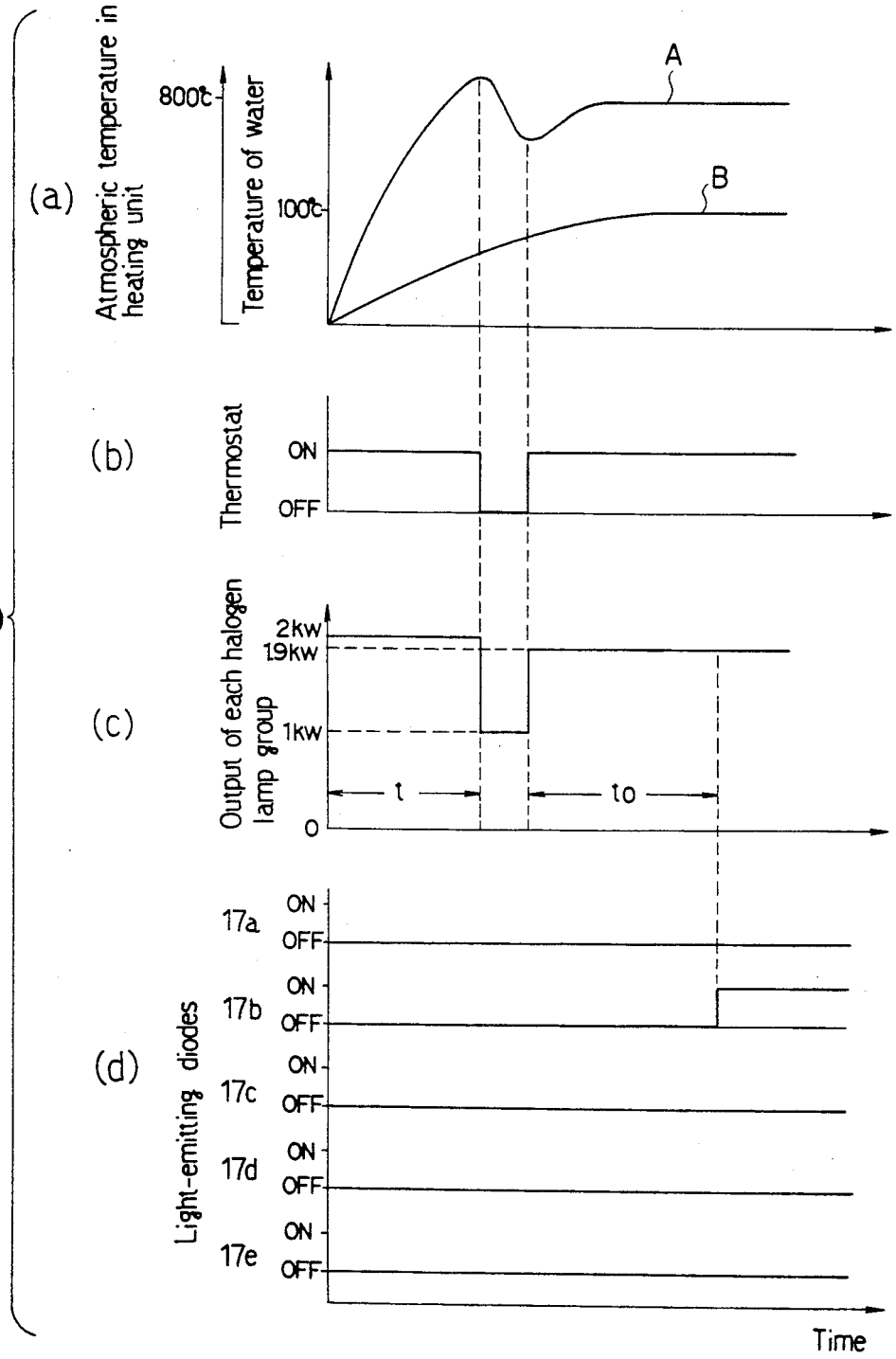
FIGS. 9(*a*) to 9(*d*) and 10(*a*) to 10(*d*) are views similar to FIGS. 6(*a*) to 6(*d*) and 7(*a*) to 7(*d*) showing another embodiment of the invention, respectively.

FIGS. 9(*a*)–9(*d*) and 10(*a*)–10(*d*) show another embodiment of the invention. This embodiment differs from the foregoing embodiment in the time when the microcomputer 19 determines the suitability of the cooking pan to activate either one of the light-emitting diodes 17*a*–17*e*. More specifically, in the second embodiment, when the output of each halogen lamp 3 group is not decreased for a predetermined period of time $t_0$, the suitability of the cooking pan is determined to be displayed at the end of the period $t_0$. For example, FIGS. 9(*a*)–9(*d*) show the case where a cooking pan with high heat absorptivity as in the case of FIGS. 6(*a*)–6(*d*). Each halogen lamp 3 group generates heat at the output of 2 kW immediately after initiation of energization. The thermostat is turned off after a relatively short period of time t from the energization initiation, which period t is shorter the predetermined period $t_0$ in the foregoing embodiment. The output of each halogen lamp 3 group is decreased to the low output of 1 kW as the result of turn-off of the thermostat 8. Subsequently, when the thermostat 8 is turned on, the output of each halogen lamp 3 group is increased to 1.9 kW. Since the calorific value of each halogen lamp 3 at 1.9 kW is balanced with the amount of heat absorbed by the cooking pan, the output of each halogen lamp 3 group is maintained at the value of 1.9 kW. When the constant output (1.9 kW) condition continues for a predetermined period of time $t_0$, the microcomputer 19 operates at the end of the period $t_0$ to determine that the suitability of the cooking pan is in the rank B and to activate the corresponding light-emitting diode 17*b*.

Figure 10:
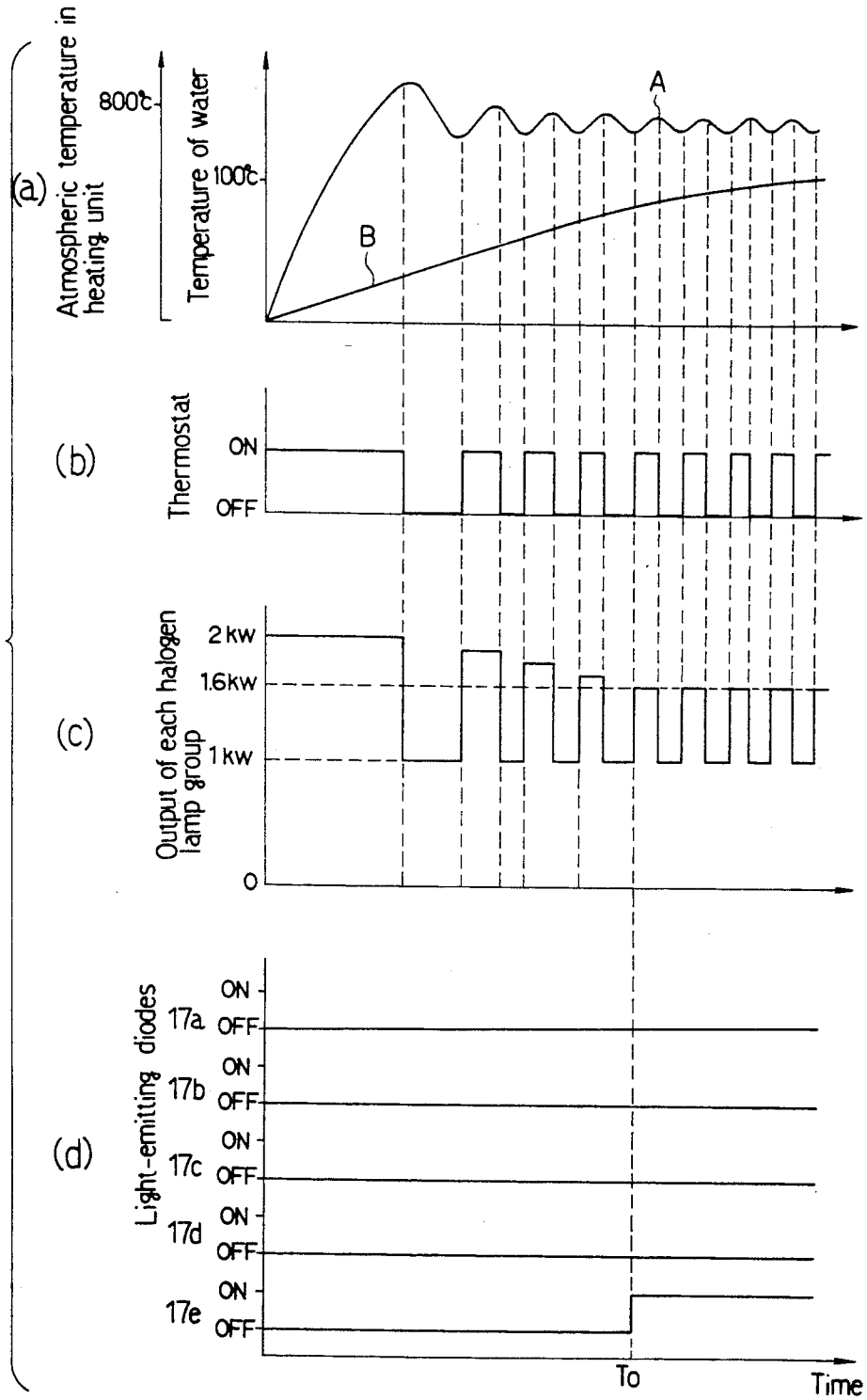

On the other hand, in the case of the cooking pan with low heat absorptivity as shown in FIGS. 10(*a*)–10(*d*), the output of each halogen lamp 3 group is finally decreased to the limit decrease output of 1.6 kW. In such a case, the microcomputer 19 operates to determine that the suitability of the cooking pan is in the rank E and to activate the corresponding light-emitting diode 17*e* immediately when the output of each halogen lamp 3 group is gradually decreased to 1.6 kW at time $T_0$ in FIGS. 10(*a*)–10(*d*), without the constant output (1.6 kW) condition being continued for the period $t_0$. As the result of the microcomputer so programmed as described above, the rank displaying operation can be performed in a short period of time for the cooking pan determined as in the rank E and a measure such as exchange of the cooking pans can be quickly taken. The previous embodiment may also employ the arrangement that the suitability of the cooking pan is determined immediately when the output of each halogen lamp 3 group is gradually decreased to 1.6 kW and the corresponding light-emitting diode is activated.

The foregoing disclosure and drawings are merely illustrative of the principles of the present invention and are not to be interpreted in a limiting sense. The only limitation should be determined from the scope of the appended claims.

I claim:

1. An electric cooking appliance comprising:

a) a heater lamp;

b) a top plate on which a cooking pan containing foodstuff to be cooked is placed, the top plate being disposed over the heater lamp;

c) temperature sensing means for sensing an ambient temperature of the heater lamp;

d) output power control means outputting a controlled output value command for controlling an output of the heater lamp, the output control means controlling the output of the heater lamp so that the output of the heater lamp is gradually decreased based on the controlled output value command every time the temperature sensed by the temperature sensing means exceeds a critical temperature value for protection of the heater lamp;

e) determination means for determining a degree of heat absorptivity of the cooking pan in accordance with the controlled output value command in the condition that the cooking pan is placed on the top plate; and f) display means for displaying a result of the determination of the determination means.

2. An electric cooking appliance according to claim 1, wherein the controlled output value command in accordance with which the determination means determines the degree of heat absorptivity of the cooking pan takes a value obtained a predetermined period of time after initiation of energization of the heater lamp

3. An electric cooking appliance according to claim 1, wherein the output control command in accordance with which the determination means determines the degree of heat absorptivity of the cooking pan takes a value obtained when the control of gradually decreasing the output of the heater lamp is interrupted for a predetermined period of time or more.

4. An electric cooking appliance according to claim 1, wherein the determination means determines that the cooking pan is unsuitable when the output control command reaches a predetermined value while the heater lamp is being controlled so that the output of the heater lamp is gradually decreased.

5. An electric cooking appliance according to claim 1, wherein each of the determination means and the display means returns to an initial condition when an output adjustment of the heater lamp is performed by a user, so that the determination means and the display means perform the determining and displaying operations respectively.

6. An electric cooking appliance according to claim 2, wherein each of the determination means and the display means returns to an initial condition when an output adjustment of the heater lamp is performed by a user, so that the determination means and the display means perform the determining and displaying operations respectively.

7. An electric cooking appliance according to claim 3, wherein each of the determination means and the display means returns to an initial condition when an adjustment of the output of the heater lamp is performed by a user, so that the determination means and the display means perform the determining and displaying operations respectively.

* * * * *